US006823944B2

(12) United States Patent
Seely

(10) Patent No.: US 6,823,944 B2
(45) Date of Patent: Nov. 30, 2004

(54) APPARATUS AND METHOD FOR COMPLETING A WELL

(75) Inventor: Danny P. Seely, Bakersfield, CA (US)

(73) Assignee: Tryad Service Corporation, Shafter, CA (US)

( * ) Notice: Subject to any disclaimer, the term of this patent is extended or adjusted under 35 U.S.C. 154(b) by 129 days.

(21) Appl. No.: 10/359,886

(22) Filed: Feb. 6, 2003

(65) Prior Publication Data

US 2004/0154795 A1 Aug. 12, 2004

(51) Int. Cl.[7] ..... E21B 23/01; E21B 43/10

(52) U.S. Cl. ..... 166/382; 166/387; 166/278; 166/124; 166/208; 166/242.6

(58) Field of Search ..... 166/206, 208, 166/209, 210, 382, 387, 118, 134, 242.6, 278, 51, 124, 182

(56) References Cited

U.S. PATENT DOCUMENTS 3,721,292 A * 3/1973 Ahlstone ..... 166/359
4,479,544 A * 10/1984 Callihan et al. ..... 166/290
4,693,309 A * 9/1987 Caskey ..... 166/123
4,911,237 A * 3/1990 Melenyzer ..... 166/208

* cited by examiner

*Primary Examiner*—David Bagnell
*Assistant Examiner*—Shane Bomar
(74) *Attorney, Agent, or Firm*—James M. Duncan

(57) ABSTRACT

A method and apparatus for sealing the top of a liner within a casing string of an oil well which does not require a second trip of the work string to seal off the top of the liner within the casing. The liner, connected to the apparatus, is run into the well on a work string until the bottom of the liner sets on the bottom of the well. After the bottom of the liner is set on the bottom of the well and, if desired, a gravel slurry is circulated into place, the apparatus is actuated by setting weight on the work string, which causes a cylindrical sealing element to expand and seal against the inside wall of the casing. The apparatus does not require slips to hold it in position within the casing.

26 Claims, 4 Drawing Sheets

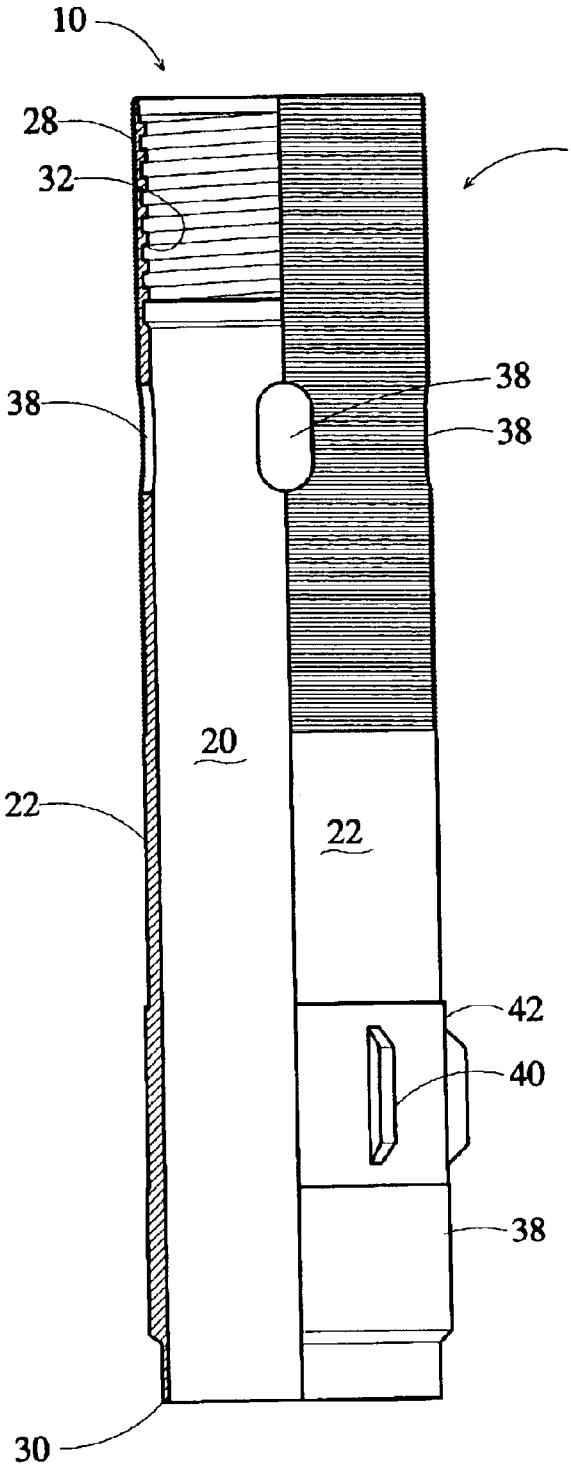
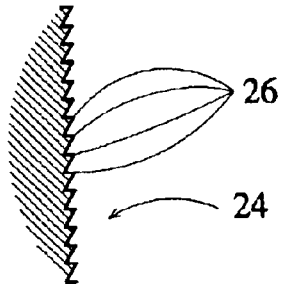
FIG. 2A
FIG. 2

APPARATUS AND METHOD FOR COMPLETING A WELL

BACKGROUND OF THE INVENTION

The present invention generally relates to devices and methods for completing oil and gas wells, and more specifically to a method and apparatus which provides an economic and relatively simple means of sealing the top of a liner within a casing string.

It is well known to those in the oil and gas industry to complete oil and gas wells with a liner across the production interval of the well. The liner might be set in an "open hole" section at the bottom of the well or the liner might be set within a cased section of the well. In either case, when the liner is placed within the well, an annulus is created. The annulus comprises the planar surface defined by the space between the outside wall of the liner and, depending upon whether the liner is set in open hole or in a cased section of the well, either the inside diameter of the casing, or the diameter of the open hole. Generally, the top of the liner extends upwardly such that the top of the liner is within a cased section of the well.

It is often desirable or required that the annular space between the top of the liner and the inside diameter of the casing be scaled so as to prevent flow of reservoir fluids or completion materials around the top of the liner into the casing above the liner. Various means are known within the oil and gas industry for sealing the top of the liner, which include placing a cement seal in the annular space, having a seal element between the top of the liner and the inside wall of the casing, or driving a moldable material, such as lead, over the top of the liner. The type of seal will often be dictated by the operational requirements for the well, including the required pressure and temperature ratings.

Gravel packing operations are one example where it is usually desirable to seal off the top of the liner to prevent flow of reservoir fluids and/or to prevent gravel from migrating around the top of the liner. Gravel packing is used to control the flow of reservoir sand into the well bore by circulating gravel into the well, such that the gravel is placed between the liner (or sand screen) and the producing formation.

In one form of gravel packing, the liner is run into the well on a tool string until the liner rests on the bottom of the well. At the top of the liner is a landing nipple which is connected to the tool string. A gravel slurry is then pumped down the tool string and around the liner. After the gravel slurry is in place between the liner and the producing formation, the tool string is removed, leaving the top of the liner facing upwardly within the casing. A drive-over adapter is thereafter run into the well on a work string, where the drive-over adapter is driven over the top of the liner to form a seal between the outside diameter of the top of the liner and the inside diameter of the casing. While this method provides a relatively inexpensive well completion, it nevertheless requires additional rig time to make a second trip with the work string to run in the drive-over adapter.

SUMMARY OF THE INVENTION

The present invention is directed to an apparatus and method for sealing the top of a liner within a casing string of an oil well which does not require a second trip of the work string to seal off the top of the liner within the casing. The liner, connected to the apparatus, is run into the well on a work string until the bottom of the liner sets on the bottom of the well. After the bottom of the liner is set on the bottom of the well and, if desired, a gravel slurry is circulated into place, the apparatus is actuated by setting weight on the work string, which causes a cylindrical sealing element to expand and seal against the inside wall of the casing.

One embodiment of the apparatus comprises a hollow cylindrical mandrel having an inside surface, an exterior surface, a first end and a second end. The first end and second end define a longitudinal axis, the first end having a first set of internal threads adapted to engage the threads of a run-in tool and the second end adapted to connect to the top of the liner. The exterior surface comprises a wicker section having a plurality of first wicker members disposed circumferentially about the mandrel. The mandrel further comprises a plurality of slots extending from the inside surface to the exterior surface, each slot having a major axis coincidental with the longitudinal axis. An outer cylindrical housing, a cylindrical lock ring, a cylindrical sealing element, and a cylindrical slip ring, are slidably disposed over the exterior surface of the mandrel along the longitudinal axis in relative order, the lock ring adjacent to the wicker section of the mandrel. The outer cylindrical housing further comprises a top end which is adjacent to the first end of the mandrel, the top end having a second set of internal threads adapted to engage the threads of the run-in tool when the run-in tool is disengaged from the first set of internal threads. The cylindrical housing further comprises a plurality of tapped holes extending through the wall of the housing, each hole configured to overlay one of the slots of the mandrel. The lock ring comprises an inside surface having a plurality of second wicker members adapted to engage one or more of the first wicker members of the mandrel. The apparatus further comprises a plurality of lugs for insertion into the holes of the cylindrical housing, each lug extending into the slot which coincides with the hole. Each lug has a head and a body section, the body section being threaded to be received by the tapped hole, each lug having a length such that the body section extends into the slot but does not penetrate beyond the interior surface of the mandrel, such that the inside diameter of the mandrel is not restricted by the lugs.

These and other features, aspects, and advantages of the present invention will become better understood with regard to the following description, appended claims, and accompanying drawings.

BRIEF DESCRIPTION OF THE DRAWINGS

FIG. 2 is a quarter-sectional view of the mandrel of the embodiment depicted in FIG. 1.

FIG. 2A is a detailed view of the wicker section of the mandrel depicted in FIG. 2.

DETAILED DESCRIPTION OF THE EMBODIMENTS

Figure 1A:
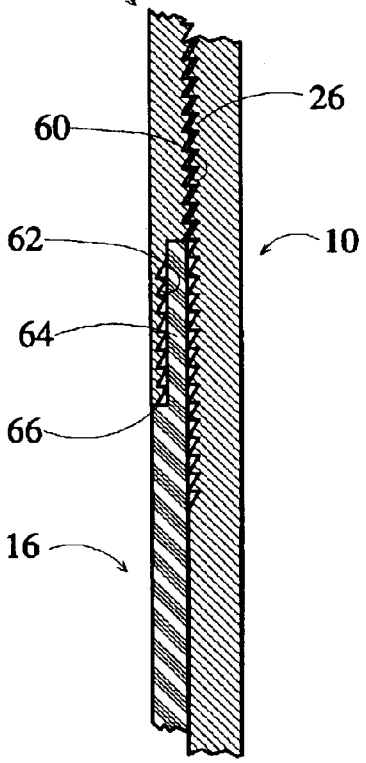
FIG. 1A is detailed view of the wicker sections of the mandrel and lock ring depicted in FIG. 1.
Figure 1:
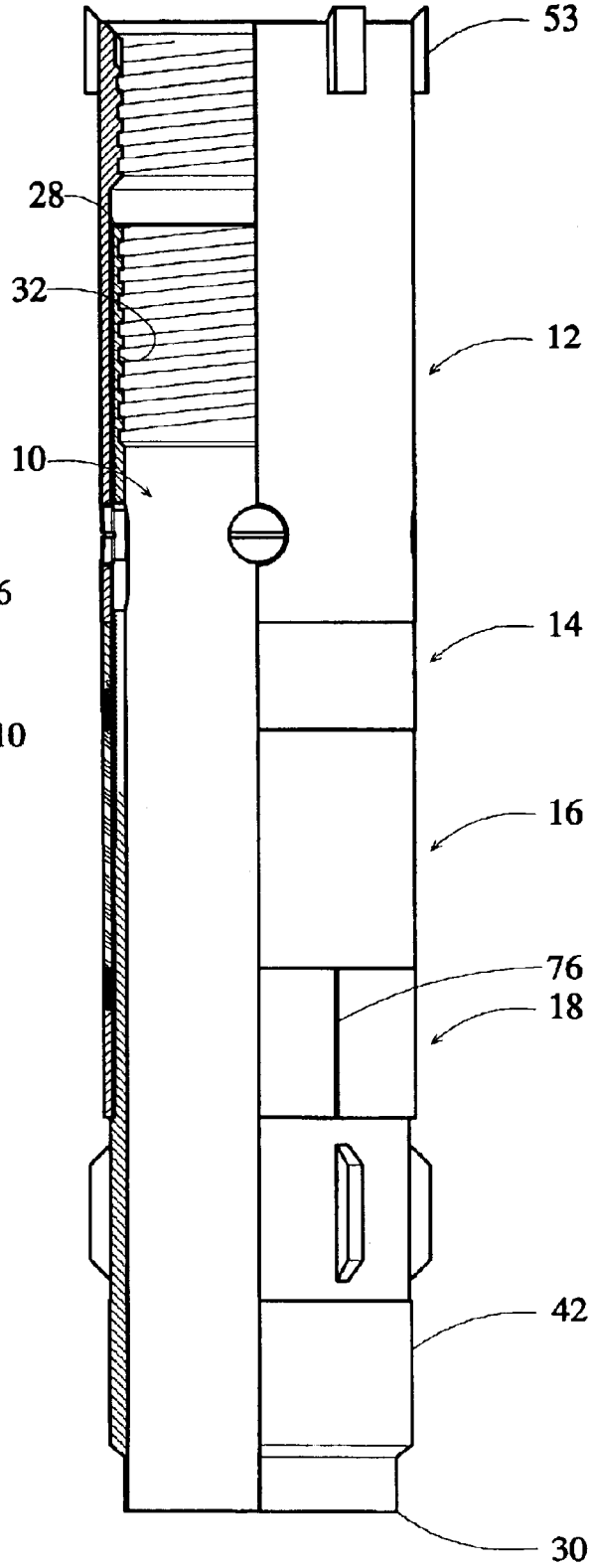
FIG. 1 is a quarter-sectional view of one embodiment of the present device.
Figure 7:
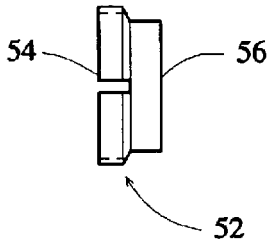
FIG. 7 is a side view of a lug.
Figure 3:
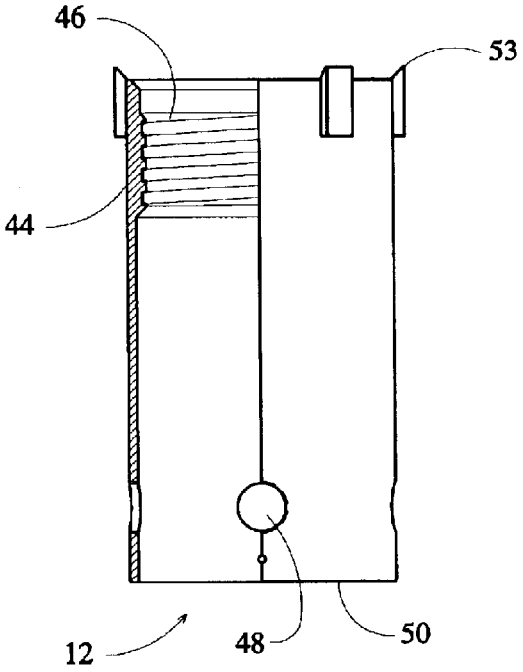
FIG. 3 is a quarter-sectional view of the outer cylindrical housing of the embodiment depicted in FIG. 1.

Referring now specifically to the drawings, FIG. 1 shows a quarter-sectional view of one embodiment of the disclosed device. This embodiment comprises a hollow cylindrical mandrel 10, depicted in detail in FIG. 2, an outer cylindrical housing 12, depicted in detail in FIG. 3, a lock ring 14, depicted in detail in FIG. 4, a seal element 16, depicted in detail in FIG. 5, and a slip ring 18, depicted in detail in FIG. 6.

The mandrel 10 has an inside surface 20 which is preferably full opening through the body of the mandrel to allow smaller diameter production equipment or tools to pass through the mandrel without obstruction. It is to be appreciated that the size of the components of the device, including the inside diameter of the mandrel 10, will vary according to the size of casing the liner is to be set within. In order to obtain a tight seal with the seal element 16 against the inside diameter of the casing, the largest tool which may be safely run through the casing should be used. By way of example, if the liner is to be set within 7 inch diameter casing having a weight of 26 pounds per foot, the maximum outside diameter of the tool should be 6.276 inches. For this size embodiment, the mandrel may be fabricated from 5.5 inch 17 pound per foot K55 casing material, having a maximum inside diameter of 4.892 inches.

The mandrel 10 also has an exterior surface 22. The exterior surface 22 has a wicker section 24 which is fabricated on a portion of the exterior surface. As shown in detail in FIG. 2A, the wicker section 24 comprises a plurality of first wicker members 26 disposed circumferentially about the mandrel 10. Each wicker member 26 may have a sawtooth profile suitable for engaging an opposed and opposite facing wicker member on the inside diameter of the lock ring 14 which is slid over the mandrel 10. An acceptable pitch for the wicker section 24 on a mandrel fabricated from 5.5 inch 17 pound per foot K55 casing material is ten wicker members 26 per inch.

Figure 8:
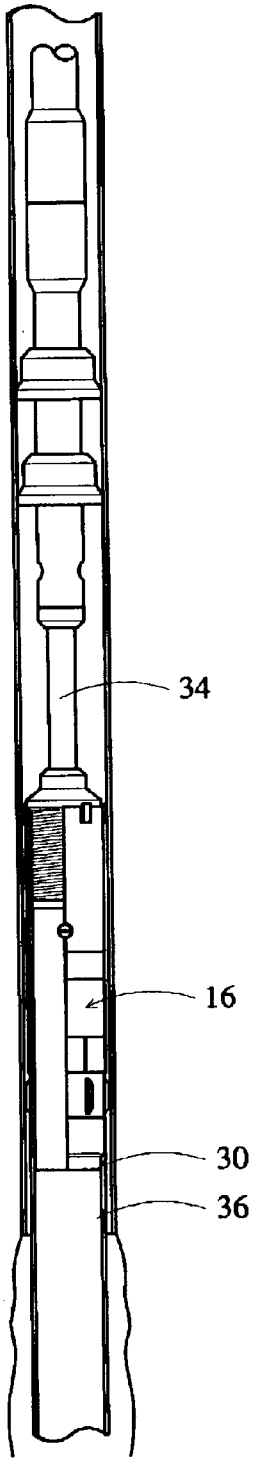
FIG. 8 is a schematic quarter-sectional view of one embodiment of the disclosed device being run into a well attached to a gravel pack tool.
Figure 9:
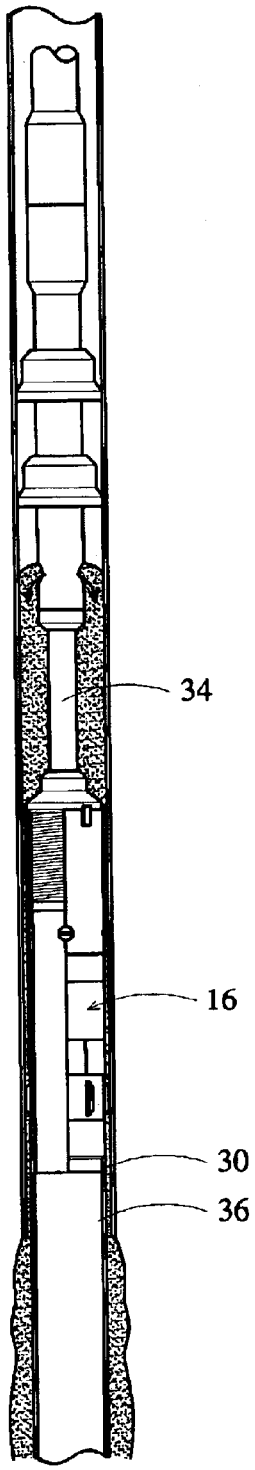
FIG. 9 is a schematic cross-sectional view of one embodiment of the disclosed device in which a gravel slurry is pumped out of the gravel pack tool and around the sealing element of the disclosed device.
Figure 10:
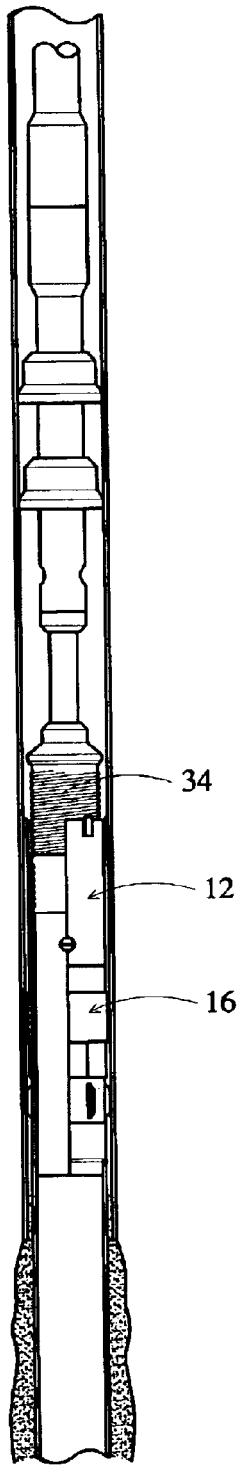
FIG. 10 is a schematic cross-sectional view of one embodiment of the disclosed device in which the gravel slurry has been placed around the liner and the gravel pack tool manipulated to expand the seal element.

Mandrel 10 further comprises a first end 28 and a second end 30. The first end 28 and second end 30 define a longitudinal axis. First end 28 has a first set of internal threads 32 which are adapted to engage the threads of a run-in tool 34, as shown in FIGS. 8 through 10. Also shown in FIGS. 8 through 10 is second end 30, which is attached to the top of the liner 36 by either welded or threaded connection.

The internal threads 32 of mandrel 10 should be of a type and variety suitable for oilfield service. It is to be appreciated that it may be desirable to use a reverse thread for internal threads 32. When setting the tool, the work string is usually rotated, thereby causing the threads of the running tool to back off from the internal threads 32 of the mandrel 10, so the use of a reverse thread will prevent the work string coming apart at other undesired locations when rotating the work string.

The mandrel 10 further comprises a plurality of slots 38 extending from the inside surface of the mandrel to the exterior surface 22. The slots 38 may be located at the same longitudinal position on mandrel 10, with a total of three slots phased at 120 degrees intervals around the circumference of the mandrel. Each slot 38 has a major axis coincidental with the longitudinal axis of the mandrel 10. Mandrel 10 may also have a plurality of lower centralizers 40 as shown in FIG. 2. The centralizers 40 serve to centralize the apparatus in the casing.

Outer cylindrical housing 12, lock ring 14, cylindrical sealing element 16, and slip ring 18, are slidably disposed over exterior surface 22 along the longitudinal axis of the mandrel 10 in relative order. The outside diameter of bottom section 42 of the mandrel 10 is larger than the inside diameters of housing 12, lock ring 14, sealing element 16 and slip ring 18, such that each of those components is retained above the bottom section. The lock ring 14 is set adjacent to a portion of the wicker section 24 of the mandrel 10.

The outer cylindrical housing 12 comprises a top end 44 such that when the housing is slipped over the exterior surface 22 of mandrel 10, top end 44 is adjacent to first end 28 of the mandrel 10. However, as shown in FIG. 1, top end 44 does not overlap the internal threads 32 of the mandrel 10. Top end 44 has its own set of internal threads 46 adapted to engage the threads of the run-in tool 34 when the run-in tool is disengaged from the internal threads 32 of the mandrel 10. For example, if internal threads 32 are reverse threads, if the work string is rotated to the right, the threads of the run-in tool 34 will disengage from the internal threads 32 of the mandrel 10, while simultaneously engaging the internal threads 46 of the outer cylindrical housing 12, until the run-in tool is completely disengaged from the mandrel.

The cylindrical housing 12 further comprises a plurality of tapped holes 48, which may be located adjacent to the bottom end 50 of the housing. The holes 48 extend through the wall of the housing 12. Each hole 48 is configured to overlay a slot 38 of the mandrel 10. Lugs 52 are inserted into the holes 48. Each lug 52 has a head 54 and a body section 56. The body section 56 is threaded to be received by the tapped hole 48. The body section 56 has such a length that the body section extends into slot 38 but does not penetrate beyond the inside surface 20 of the mandrel 10, such that the inside diameter of the mandrel is not restricted by the lugs 52. Upper centralizers 53 may also be attached to the cylindrical housing 12.

The lock ring 14 is cylindrical in shape and comprises an inside surface 58 having a plurality of second wicker members 60 adapted to engage one or more of the first wicker members 26 of the mandrel 10. As shown in detail in FIG. 1A, the second wicker members 60 of the lock ring 14 have a sawtooth profile which matches that of the first wicker members 26, but the lock ring 14 is installed such that the direction of the profile of the second wicker members 60 is opposite to that of the first wicker members 26. Therefore, lock ring 14 may be slid in a downward direction (i.e., toward the well bottom) along mandrel 10 such that the second wicker members 60 slide past the first wicker members 26, but the lock ring is locked from moving in an upward direction by the engagement of the first wicker members and the second wicker members.

Figure 4A:
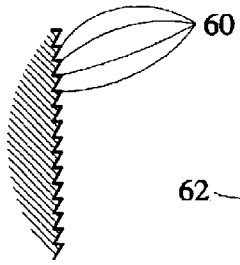
FIG. 4A is a detailed view of the wicker section of the lock ring depicted in FIG. 4.
Figure 4:
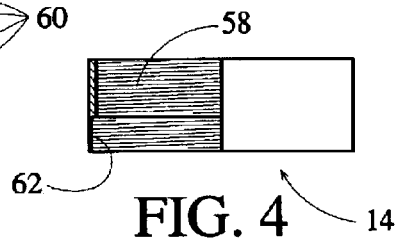
FIG. 4 is a quarter-sectional view of the lock ring of the embodiment depicted in FIG. 1.

As shown in FIG. 4, the inside surface 58 of lock ring 14 may further comprise a plurality of third wicker members 62. The third wicker members 62 are adjacent to the edge of seal element 16. As shown in detail in FIG. 1A, when lock ring 14 slides downward along the mandrel 10, the third wicker members 62 engage the outside diameter 64 of the seal element 16, and the leading edge 66 of the lock ring abuts the edge of the seal element. These contact points between the lock ring 14 and the seal element 16 further enable the sealing element to expand radially outward as its length is compressed by the downward movement of the lock ring.

Figure 5:
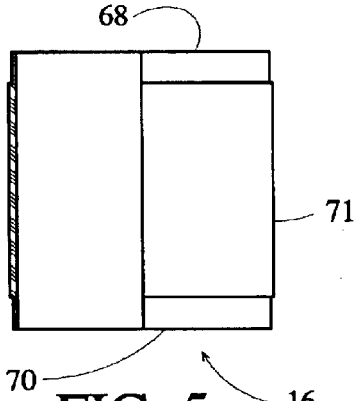
FIG. 5 is a quarter-sectional view of the sealing element of the embodiment depicted in FIG. 1.
Figure 6A:
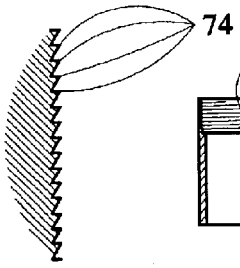
FIG. 6A is a detailed view of the wicker section of the slip ring depicted in FIG. 6.
Figure 6:
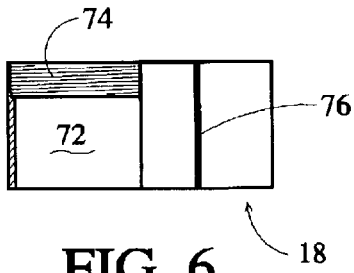
FIG. 6 is a quarter-sectional view of the slip ring of the embodiment depicted in FIG. 1.

The seal element 16, is cylindrical in shape and comprises a hollow cylindrical member which is comprised of a compressible material, such as elastomers or fluoroelastomers including VITON®. Depending upon the pressure and temperature requirements for the seal element 16, it may also be beneficial to include TEFLON®, a fluoropolymer resin, as an additive to the elastomer material used for the seal element. The seal element 16 may be fashioned such that the seal element has a top section 68, a bottom section 70, and a middle section 71. Top section 68 and/or bottom section 70 may have outside diameters which are less than the maximum outside diameter of the seal element 16, located at middle section 71, as shown in FIG. 5. The reduced diameter of the top section 68 and the bottom section 70 allow the lock ring 14 on the top and the slip ring 18 on the bottom to partially overlap the seal element 16. The seal element 16 should be sized such that the largest uncompressed element which might safely be installed in the casing should be run, so that when the seal element is compressed, a tighter seal will be formed. For example, for an apparatus which is to be set within 7 inch diameter casing, a suitable seal element 16 is one having a maximum outside diameter of 6.10 inches.

The slip ring 18 comprises a cylindrical member which has inside surface 72. Inside surface 72 may further comprise a plurality of fourth wicker members 74, which may engage the bottom section 70 of the seal element. Slip ring 18 is retained on the mandrel 10 by bottom section 42, which has a larger diameter than the inside diameter of the slip ring. As apparent from the drawing figures, slip ring 18 backs up against the bottom section 42 such that the seal element 16 is sandwiched and compressed between lock ring 14 and the slip ring. Slip ring 18 may also have a longitudinal split 76 in one of the walls, which allows the lock ring 14 to slide down the mandrel 10 with less weight stacked out on the work string.

Setting the tool is relatively easy. The liner 36 is connected to the second end 30 of the mandrel 10 by welding or other attachment means. Run-in tool 34 is made up to internal threads 32 of the mandrel 10. The liner is run into the well until the bottom of the liner rests at the bottom of the well. At this point, if desired, gravel packing operations are initiated and the gravel pack slurry is circulated around the liner or sand screen. Once the desired operations have been completed, the work string is rotated so that the run-in tool 34 disengages from the internal threads 32 of the mandrel 10, and engages the internal threads 46 of the outer cylindrical housing 12. If reverse threads are used on the run-in tool 34, the internal threads 32 of the mandrel 10 and the internal threads 46 of the housing 12, the work string is rotated clockwise.

Once the run-in tool has been disengaged from the internal threads 32 of the mandrel 10 and engaged to internal threads 46 of the housing 12, if the weight of the work string is slacked off, the housing 12 will move downward with respect to the mandrel 10 as far as allowed by the movement of lug 52 within slot 38, thereby compressing seal element 16 between the lock ring 14 and the slip ring 18, causing the seal element to expand radially into the inside wall of the casing. As housing 12 moves downward with respect to the mandrel 10, the second wicker members 60 of the lock ring 14 will slide past the first wicker members 26 of the mandrel, thereby locking the lock ring and maintaining the seal element 16 in a compressed state. If it is desired to remove the apparatus, a run-in tool 34 may engage the internal threads 32 of the mandrel 10 and the work string pulled upward, causing the lock ring 14 to disengage and the sealing element 16 to contract sufficiently so that the apparatus and liner might be removed.

Except for the seal element, the components of the apparatus should be manufactured from materials which have strength and corrosion resistance properties suitable for the particular application, which may include carbon steel or alloys.

It is to be appreciated that because the disclosed device is used only in installations where the liner is set on bottom, there is no need for the device to have slip mechanisms to hold the device in place, allowing for a relatively inexpensive way to obtain a seal between the top of the liner and the concentric casing.

While the above is a description of various embodiments of the present invention, further modifications may be employed without departing from the spirit and scope of the present invention. For example, the size, shape, position and/or material of the various components may be changed as desired. Thus the scope of the invention should not be limited by the specific structures disclosed. Instead the true scope of the invention should be determined by the following claims.

What is claimed is:

1. An apparatus for sealing the top of a liner within a casing string of an oil well where the apparatus, in combination with a liner attached to the bottom of the apparatus, is run into the well on a work string until the bottom of the liner sets on the bottom of the well, the apparatus comprising:

(a) a hollow cylindrical mandrel comprising an inside surface, an exterior surface, a first end and a second end, the first end and second end defining a longitudinal axis, the first end having a first set of internal threads adapted to engage a run-in tool attached to the work string and the second end is adapted to connect to the top of the liner;

(b) the exterior surface comprising a wicker section having a plurality of first wicker members disposed circumferentially about the mandrel;

(c) the mandrel further comprising a plurality of slots extending from the inside surface to the exterior surface, each slot having a major axis coincidental with the longitudinal axis;

(d) an outer cylindrical housing, a cylindrical lock ring, a cylindrical sealing element, and a cylindrical slip ring, said housing, lock ring, sealing element and slip ring each having an inside diameter and slidably disposed on the exterior surface of the mandrel along the longitudinal axis in relative order, the lock ring adjacent to the wicker section;

(e) the outer cylindrical housing further comprising a top end, the top end adjacent to the first end of the mandrel, the top end having a second set of internal threads adapted to engage the run-in tool when the run-in tool is disengaged from the first set of internal threads, the housing further comprising a plurality of tapped holes extending through the wall of the housing, each hole configured to overlay one of the slots of the mandrel;

(f) the lock ring comprising an inside surface comprising a plurality of second wicker members adapted to engage one or more of the first wicker members of the mandrel; and (g) a plurality of lugs for insertion into the holes and coinciding slots, each lug having a head and a body section, the body section being threaded to be received by the tapped hole, each lug having a length such that the body section extends into the slot but does not penetrate beyond the interior surface.

2. The apparatus of claim 1 wherein the sealing element comprises a fluoroelastomer.

3. The apparatus of claim 1 wherein the sealing element comprises a fluoropolymer resin.

4. The apparatus of claim 2 wherein the sealing element comprises a fluoropolymer resin.

5. The apparatus of claim 1 wherein the first wicker members and the second wicker members have a sawtooth profile.

6. The apparatus of claim 1 wherein the outer cylindrical housing further comprises an outside surface, the outside surface comprising a plurality of centralizers.

7. The apparatus of claim 1 wherein the first set of threads and the second set of threads are reverse threads.

8. The apparatus of claim 1 wherein the second end of the mandrel has an outside diameter larger than the internal diameter of the slip ring.

9. The apparatus of claim 1 wherein the slip ring further comprises a longitudinal split.

10. The apparatus of claim 1 wherein the sealing element comprises a top section, a middle section and a bottom section, the top section and bottom section having a diameter less than the diameter of the middle section.

11. The apparatus of claim 10 wherein the inside surface of the lock ring comprises a plurality of third wicker members, the third wicker members engaging the top section of the seal element.

12. The apparatus of claim 11 wherein the inside surface of the slip ring comprises a plurality of fourth wicker members, the fourth wicker members engaging the bottom section of the seal element.

13. An apparatus for sealing the top of a liner within a seven inch diameter casing string of an oil well where the apparatus, in combination with the liner, is run into the well on a work string until the bottom of the liner sets on the bottom of the well, the apparatus comprising:

(a) a hollow cylindrical mandrel having a maximum outside diameter of 5.5 inches, the mandrel comprising an inside surface, an exterior surface, a first end and a second end, the first end and second end defining a longitudinal axis, the first end having a first set of internal threads adapted to engage a run-in tool and the second end adapted to connect to the top of the liner;

(b) the exterior surface comprising a wicker section having a plurality of first wicker members disposed circumferentially about the mandrel;

(c) the mandrel further comprising a plurality of slots extending from the inside surface to the exterior surface, each slot having a major axis coincidental with the longitudinal axis;

(d) an outer cylindrical housing having a maximum outside diameter of 6.0 inches, a cylindrical lock ring, a cylindrical sealing element, and a cylindrical slip ring, said housing, lock ring, sealing element and slip ring slidably disposed on the exterior surface along the longitudinal axis in relative order, the lock ring adjacent to the wicker section;

(e) the outer cylindrical housing further comprising a top end, the top end adjacent to the first end of the mandrel, the top end having a second set of internal threads adapted to the run-in tool when the run-in tool is disengaged from the first set of internal threads, the housing further comprising a plurality of tapped holes extending through the wall of the housing, each hole configured to overlap one of the slots of the mandrel;

(f) the lock ring comprising an inside surface comprising a plurality of second wicker members adapted to engage the first wicker members of the mandrel; and (g) a plurality of lugs for insertion into the holes and coinciding slots, each lug having a head and a body section, the body section being threaded to be received by the tapped hole, each lug having a length such that the body section extends into the slot but does not penetrate beyond the interior surface.

14. The apparatus of claim 13 wherein the sealing element comprises a fluoroelastomer.

15. The apparatus of claim 13 wherein the sealing element comprises fluoropolymer resin.

16. The apparatus of claim 14 wherein the sealing element comprises fluoropolymer resin.

17. The apparatus of claim 13 wherein the first wicker members and the second wicker members have a sawtooth profile.

18. The apparatus of claim 13 wherein the outer cylindrical housing further comprises an outside surface, the outside surface comprising a plurality of centralizers.

19. The apparatus of claim 13 wherein the first set of threads and the second set of threads are reverse threads.

20. The apparatus of claim 13 wherein the second end of the mandrel has an outside diameter larger than the internal diameter of the slip ring.

21. The apparatus of claim 13 wherein the slip ring further comprises a longitudinal split.

22. The apparatus of claim 13 wherein the sealing element comprises a top section, a middle section and a bottom section, the top section and bottom section having a diameter less than the diameter of the middle section.

23. The apparatus of claim 22 wherein the inside surface of the lock ring comprises a plurality of third wicker members, the third wicker members engaging the top section of the seal element.

24. The apparatus of claim 23 wherein the inside surface of the slip ring comprises a plurality of fourth wicker members, the fourth wicker members engaging the bottom section of the seal element.

25. A method for sealing the top of a liner within a casing string of an oil well comprising the steps of:

(a) attaching the run-in tool to an apparatus, the apparatus comprising:

(1) a hollow cylindrical mandrel comprising an inside surface, an exterior surface, a first end and a second end, the first end and second end defining a longitudinal axis, the first end having a first set of internal threads adapted to engage the threads of a run-in tool attached to the work string and the second end is adapted to connect to the top of the liner;

(2) the exterior surface comprising a wicker section having a plurality of first wicker members disposed circumferentially about the mandrel;

(3) the mandrel further comprising a plurality of slots extending from the inside surface to the exterior surface, each slot having a major axis coincidental with the longitudinal axis;

(4) an outer cylindrical housing, a cylindrical lock ring, a cylindrical sealing element, and a cylindrical slip ring, said housing, lock ring, sealing element and slip ring each having an inside diameter and slidably disposed on the exterior surface along the longitudinal axis in relative order, the lock ring adjacent to the wicker section;

(5) the outer cylindrical housing further comprising a top end, the top end adjacent to the first end of the mandrel, the top end having a second set of internal threads adapted to engage the threads of the run-in tool when the run-in tool is disengaged from the first set of internal threads, the housing further comprising a plurality of tapped holes extending through the wall of the housing, each hole configured to overlay one of the slots of the mandrel;

(6) the lock ring comprising an inside surface comprising a plurality of second wicker members adapted to engage one or more of the first wicker members of the mandrel; and (7) a plurality of lugs for insertion into the holes and coinciding slots, each lug having a head and a body section, the body section being threaded to be received by the tapped hole, each lug having a length such that the body section extends into the slot but does not penetrate beyond the interior surface;

(b) connecting the second end of the mandrel to the top of the liner;

(c) running the apparatus and the attached liner into the casing string of the oil well;

(d) setting the bottom of the liner at the bottom of the well;

(e) rotating the work string to disengage the run-in tool from the first set of internal threads and to engage the run-in tool to the second set of internal threads; and (f) setting weight on the work string to expand the cylindrical sealing element.

26. A method for gravel packing an oil well comprising the steps of:

(a) attaching a circulating run-in tool to an apparatus, the apparatus comprising:

(1) a hollow cylindrical mandrel comprising an inside surface, an exterior surface, a first end and a second end, the first end and second end defining a longitudinal axis, the first end having a first set of internal threads adapted to engage the threads of the run-in tool attached to a work string and the second end is adapted to connect to the top of a liner;

(2) the exterior surface comprising a wicker section having a plurality of first wicker members disposed circumferentially about the mandrel;

(3) the mandrel further comprising a plurality of slots extending from the inside surface to the exterior surface, each slot having a major axis coincidental with the longitudinal axis;

(4) an outer cylindrical housing, a cylindrical lock ring, a cylindrical sealing element, and a cylindrical slip ring, said housing, lock ring, sealing element and slip ring each having an inside diameter and slidably disposed on the exterior surface along the longitudinal axis in relative order, the lock ring adjacent to the wicker section;

(5) the outer cylindrical housing further comprising a top end, the top end adjacent to the first end of the mandrel, the top end having a second set of internal threads adapted to engage the threads of the run-in tool when the run-in tool is disengaged from the first set of internal threads, the housing further comprising a plurality of tapped holes extending through the wall of the housing, each hole configured to overlay one of the slots of the mandrel;

(6) the lock ring comprising an inside surface comprising a plurality of second wicker members adapted to engage one or more of the first wicker members of the mandrel; and (7) a plurality of lugs for insertion into the holes and coinciding slots, each lug having a head and a body section, the body section being threaded to be received by the tapped hole, each lug having a length such that the body section extends into the slot but does not penetrate beyond the interior surface;

(b) connecting the second end of the mandrel to the top of the liner;

(c) running the apparatus and the attached liner into the casing string of the oil well;

(d) setting the bottom of the liner at the bottom of the well;

(e) circulating a gravel slurry down the work string, out the circulating run-in tool and past the sealing element until the gravel is adjacent to the liner;

(f) rotating the work string to disengage the run-in tool from the first set of internal threads and to engage the run-in tool to the second set of internal threads; and (g) setting weight on the work string to expand the cylindrical sealing element.

* * * * *